US006638187B1

(12) United States Patent
Tsai

(10) Patent No.: US 6,638,187 B1
(45) Date of Patent: Oct. 28, 2003

(54) RACKET FRAME WITHOUT THE NEED OF DRILLING HOLES

(75) Inventor: Ming Jen Tsai, Miaoli Hsien (JP)

(73) Assignee: Marshal Industrial Corporation, Miaoli Hsien (TW)

( * ) Notice: Subject to any disclaimer, the term of this patent is extended or adjusted under 35 U.S.C. 154(b) by 0 days.

(21) Appl. No.: 10/314,205

(22) Filed: Dec. 9, 2002

(51) Int. Cl.[7] ..... A63B 49/02
(52) U.S. Cl. ..... 473/540; 473/535
(58) Field of Search ..... 473/524, 535, 473/536, 539, 540, 547

(56) References Cited

U.S. PATENT DOCUMENTS 4,614,626 A * 9/1986 Frerking ..... 264/46.4
4,935,185 A * 6/1990 Mott ..... 264/257
4,981,639 A * 1/1991 Mott ..... 264/513
5,143,669 A * 9/1992 Mott ..... 264/103
5,516,100 A * 5/1996 Natsume ..... 473/535
6,071,203 A * 6/2000 Janes et al. ..... 473/535

FOREIGN PATENT DOCUMENTS

JP 6-238015 * 8/1994 ..... A63B/49/10

* cited by examiner

*Primary Examiner*—Raleigh W. Chiu
(74) *Attorney, Agent, or Firm*—Rosenberg, Klein & Lee

(57) ABSTRACT

An improved racket frame without the need of drilling holes comprises two compound material pipe bodies. A plurality of U-shaped embedded tubes are uniformly clamped between the two pipe bodies with two openings of each of the U-shaped embedded tubes facing the same direction. A compound material layer sheathes the two pipe bodies and the U-shaped embedded tubes with only the two openings of each of the U-shaped embedded tubes being exposed. The compound material layer is then placed into a mold and blown and heated to form an integral racket frame structure having th rough holes. Meshes conventionally exposed out of the racket frame are hidden in the racket frame, hence reducing abrasion of the meshes, lengthening the lifetime of use of the meshes, and enhancing the delicacy. Because there is no need of drilling holes twice, the structure of the racket frame will not be damaged.

4 Claims, 4 Drawing Sheets

RACKET FRAME WITHOUT THE NEED OF DRILLING HOLES

FIELD OF THE INVENTION

The present invention relates to a frame body structure without the need of drilling holes and, more particularly, to an improved racket frame without the need of drilling holes.

BACKGROUND OF THE INVENTION

When manufacturing a conventional racket frame, compound material in a mold is blown to form a racket frame structure. A driller is then used to drill at the periphery of the racket frame to form many circular holes, which are passed through by meshes. When batting balls, in addition to the racket face for batting, places where the meshes contact the racket frame are the most breakable parts of the meshes because abrasion between the meshes and the racket frame will cause breakage of the meshes. Moreover, the above way of drilling holes will let the edges of the circular holes be sharper, letting the meshes even more easily break.

In order to solve the above problem, a straight nail is slipped onto each of the original circular holes at the periphery of the racket frame to let the circular holes become through holes with smoother edges, hence reducing abrasion between the meshes and the racket frame. Moreover, in the above two methods, the meshes contact the outer periphery of the racket frame and the meshes are exposed out of the racket frame. Therefore, the meshes will contact ambient environments to abrade when using the racket. Furthermore, it is necessary to drill holes in the compound material racket frame in the above two methods. Not only wasting much time and cost, the structural hardness of the racket frame will also be badly affected to shorten its lifetime of use.

Accordingly, the present invention aims to propose an improved racket frame without the need of drilling holes to resolve the problems in the prior art.

SUMMARY OF THE INVENTION

The primary object of the present invention is to propose an improved racket frame without the need of drilling holes, wherein meshes conventionally exposed out of the outer periphery of the racket frame are hidden in the racket frame, hence reducing abrasion of the meshes, lengthening the lifetime of use of the meshes, and also enhancing the delicacy.

Another object of the present invention is to propose an improved racket frame without the need of drilling holes, wherein a compound material racket frame having through holes can be immediately obtained by blowing and shaping compound material in a mold. Because there is no need of drilling holes twice, the structure of the racket frame will not be damaged.

Another object of the present invention is to propose a racket frame without the need of drilling holes so as to have a simple manufacturing process, a short manufacturing time, and a lower cost.

To achieve the above objects, the present invention comprises at least two compound material pipe bodies. A plurality of U-shaped embedded tubes are uniformly clamped between the two compound material pipe bodies. Two openings of each of the U-shaped embedded tubes face the same direction. A compound material layer sheathes the compound material pipe bodies and the U-shaped embedded tubes with the two openings of each of the U-shaped embedded tubes being exposed. The compound material layer is then placed into a mold to be integrally formed by blowing. An integral racket frame structure is thus formed.

The various objects and advantages of the present invention will be more readily understood from the following detailed description when read in conjunction with the appended drawings, in which:

DETAILED DESCRIPTION OF THE PREFERRED EMBODIMENTS

Figures 1, 1A:
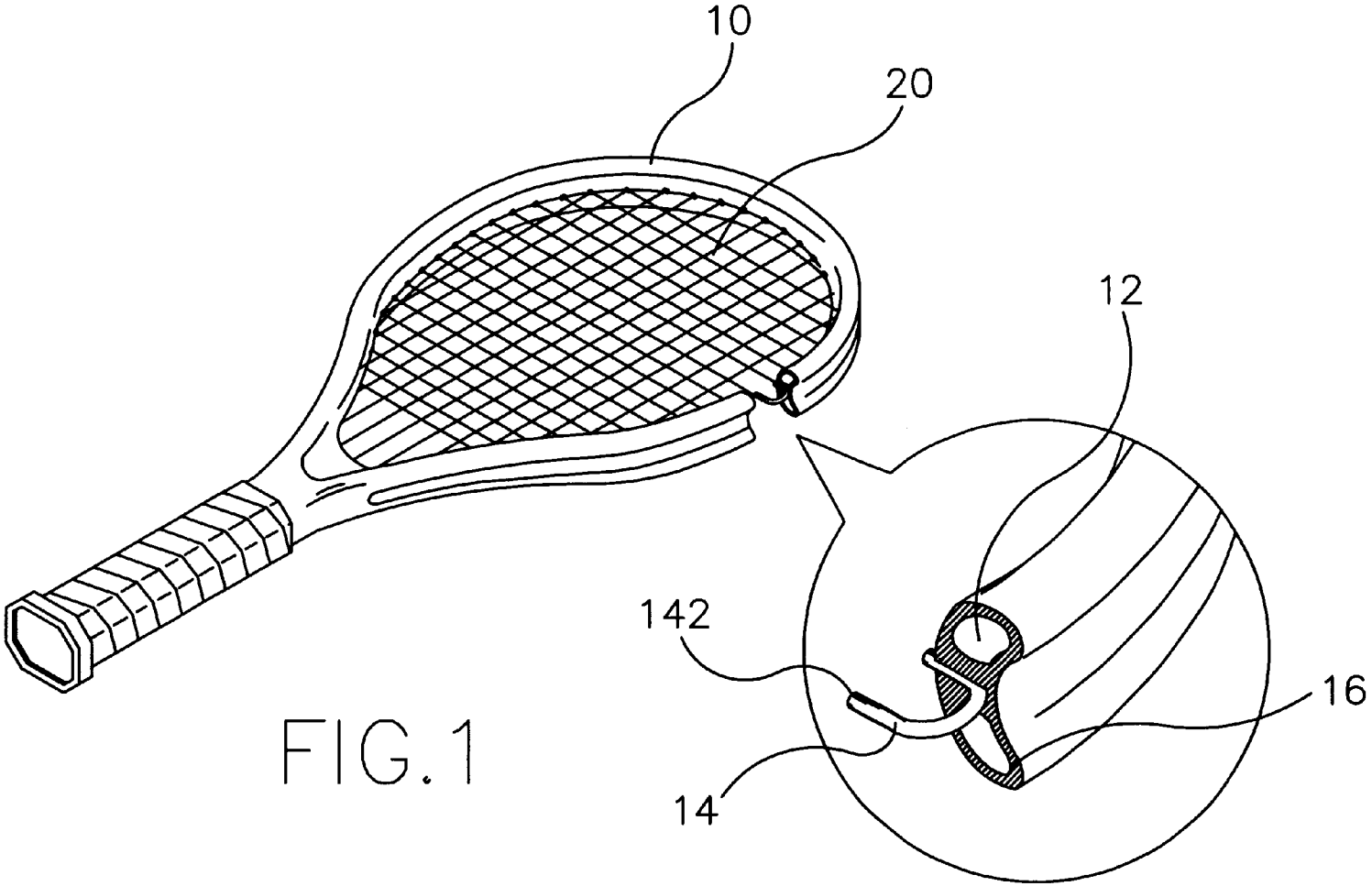
FIG. 1 and FIG. 1A are a perspective view and,a partial cross-sectional view of the present invention.
Figure 2:
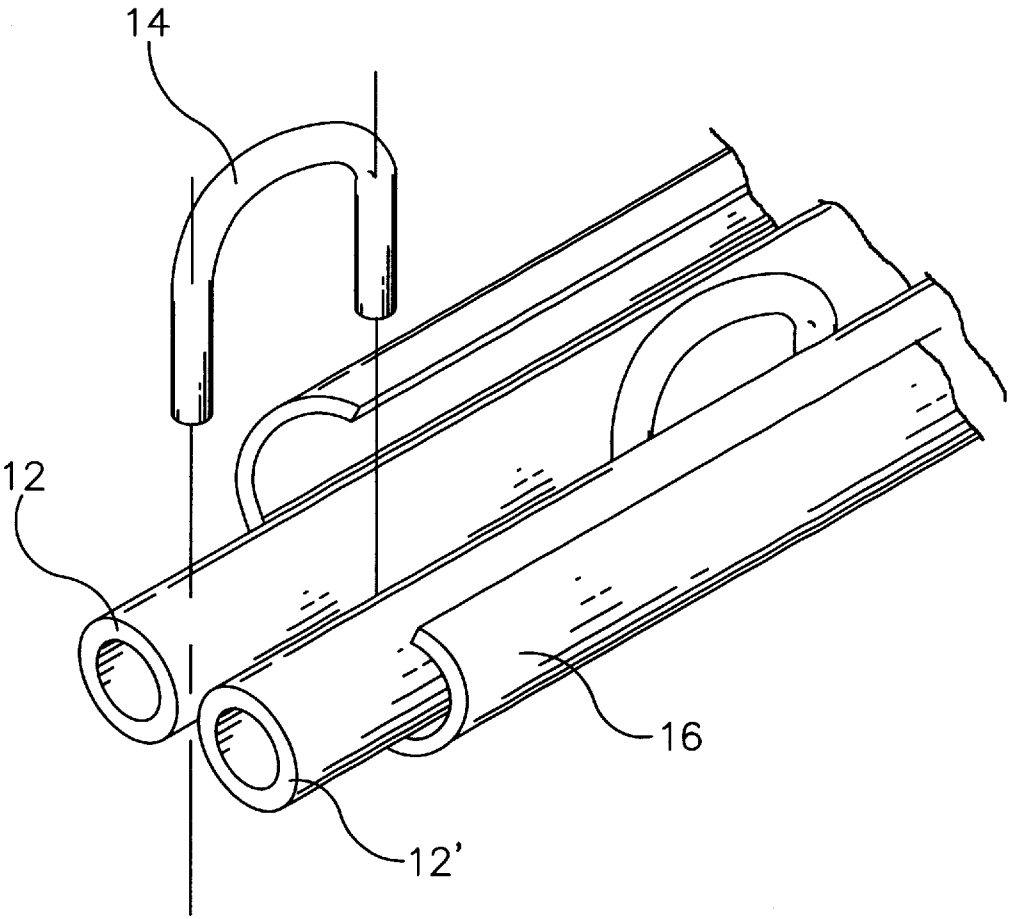
FIG. 2 is a partial exploded perspective view of a racket frame structure of the-present invention.

As shown in FIGS. 1, 1A and 2, a compound material racket frame 10 without the need of drilling holes comprises two parallel compound material pipe bodies 12 and 12'. A plurality of U-shaped embedded tubes 14 are uniformly clamped between the two compound material pipe bodies 12 and 12'. Two openings 142 of each of the U-shaped embedded tubes 14 face the same direction. A compound material layer 16 sheathes the two compound material pipe bodies , 12 and 12' and the U-shaped embedded tubes 14 with the two openings 142 of each of the U-shaped embedded tubes 14 being exposed. The compound material layer 16 sheathing the two compound material pipe bodies 12 and 12' and the U-shaped embedded tubes 14 is then placed into a mold and blown to form an integral racket frame structure.

Figure 3A:
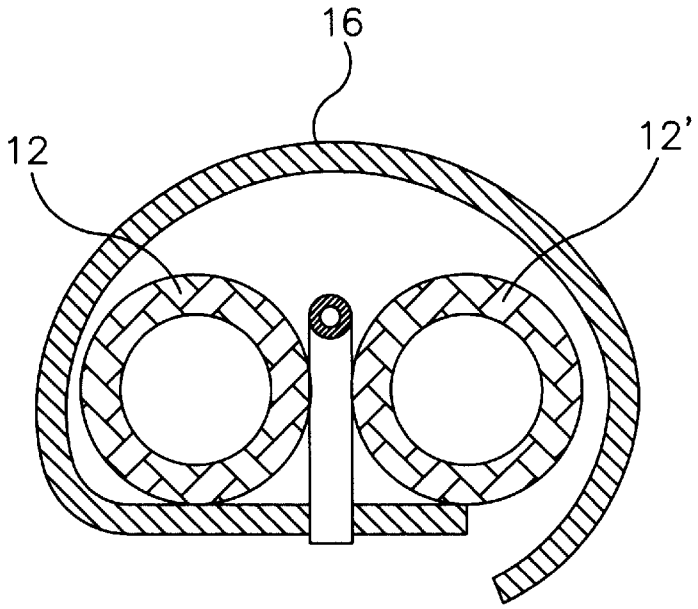
FIGS. 3A and 3B are partial cross-sectional views of the present invention before and after integral formation, respectively.
Figure 3B:
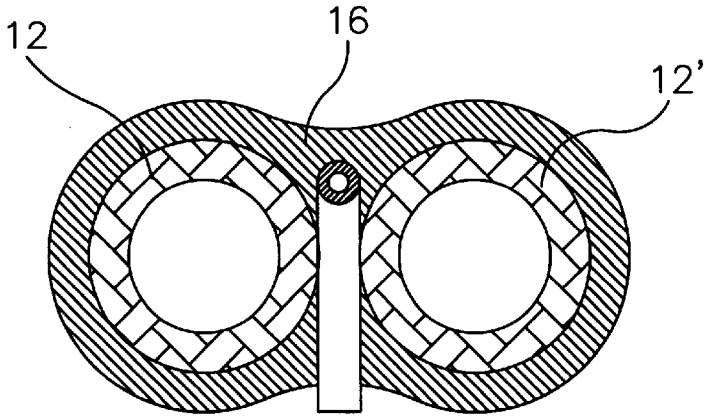
Figure 4:
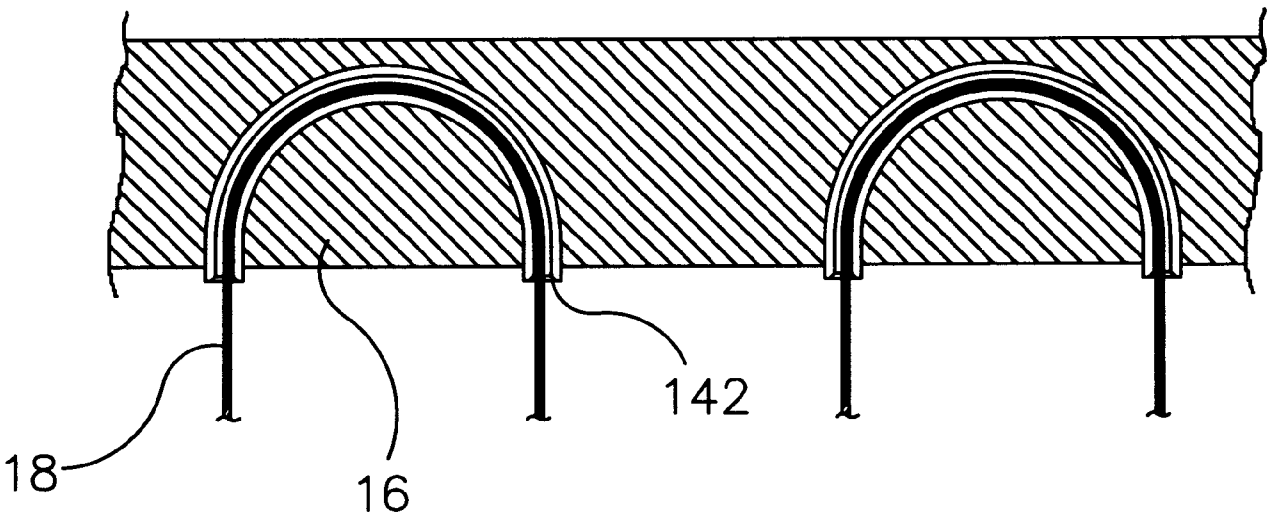
FIG. 4 is a partial cross-sectional view of the present invention.

As shown in FIGS. 3A, before the racket frame 10 is integrally formed, it is necessary to first clamp the plurality of U-shaped embedded tubes 14 uniformly between the two compound material pipe bodies 12 and 12' with all the openings 142 facing the same direction. The compound material layer 16 then is placed at the outmost layer to sheathe the two compound material pipe bodies 12 and 12' and the U-shaped embedded tubes 14 with the two openings 142 of each of the U-shaped embedded tubes 14 being exposed. Next, the above compound material layer 16 is placed in a mold and blown and heated so that the compound material pipe bodies 22 and 22' and the compound material layer 26 are integrally connected together. As shown in FIG. 3B, the compound material layer 16 is then bent toward the two openings 142 of each of the U-shaped embedded tubes 14 to form an arc shape so that the two openings 142 of each of the U-shaped embedded tubes 14 face toward the inside of the racket frame 10, hence obtaining an integrally formed racket frame 10 having through holes. As shown in FIG. 4, after an integrally formed racket frame 10 is obtained, threading of meshes 18 is performed to pass the meshes 18 in order between the exposed two openings 142 of the U-shaped embedded tubes on the racket frame 10 so as to form a racket face 20.

The inner edges of the openings of the U-shaped embedded tubes can be designed to be arc-shaped edges to prevent from breaking the meshes by abrasion. Besides, the inner wall of two side tubes of each of the U-shaped embedded tubes can also be of coned shape to increase the bore of the two side tubes of each of the U-shaped embedded tubes along the direction toward the openings. The meshes in the U-shaped embedded tubes will have a larger swing angle to provide a larger effective batting area when the meshes are subjected to a force.

To sum up, the present invention provides an improved racket frame without the need of drilling holes, wherein meshes conventionally exposed out of the outer periphery of the racket frame are hidden in the racket frame to reduce abrasion of the meshes, lengthen the lifetime of use of the meshes, and also enhance the delicacy. When manufacturing, a compound material racket frame having through holes can be immediately obtained by blowing and shaping compound material in a mold. Because there is no need of drilling holes twice, the structure of the racket frame will not be damaged. Moreover, the present invention has the advantages of a simple manufacturing process, a short manufacturing time, and a lowered cost.

Although the present invention has been described with reference to the preferred embodiments thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

I claim:

1. An improved racket frame without the need of drilling holes, comprising:

at least two compound material pipe bodies;

a plurality of U-shaped embedded tubes uniformly clamped between said compound material pipe bodies, two openings of each of said U-shaped embedded tubes facing the same direction; and a compound material layer completely sheathing said compound material pipe bodies and said U-shaped embedded tubes with said two openings of each of said U-shaped embedded tubes being exposed;

whereby an integral racket frame is formed.

2. The improved racket frame without the need of drilling holes as claimed in claim 1, wherein said compound material pipe bodies, said U-shaped embedded tubes and said compound material layer are placed in a mold to be integrally formed by blowing.

3. The improved racket frame without the need of drilling holes as claimed in claim 1, wherein inner edges of said openings of each of said U-shaped embedded tubes are arc-shaped.

4. The improved racket frame without the need of drilling holes as claimed in claim 1, wherein inner walls of two side tubes of each of said U-shaped embedded tubes are cone-shaped.

* * * * *

UNITED STATES PATENT AND TRADEMARK OFFICE

CERTIFICATE OF CORRECTION

PATENT NO. : 6,638,187 B1
DATED : October 28, 2003
INVENTOR(S) : Ming Jen Tsai

It is certified that error appears in the above-identified patent and that said Letters Patent is hereby corrected as shown below:

Title page,
Item [75], please delete the designation "(JP)" and insert the designation -- (TW) --.

Signed and Sealed this

Twentieth Day of January, 2004

JON W. DUDAS
*Acting Director of the United States Patent and Trademark Office*